US006318379B1

(12) United States Patent
Droin

(10) Patent No.: US 6,318,379 B1
(45) **Date of Patent: *Nov. 20, 2001**

(54) DEVICE TO HOLD THE HAIR

(76) Inventor: Michel Droin, Place Benoit Raclet, 71570 Romaneche, Thorins (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/550,218

(22) Filed: Apr. 17, 2000

Related U.S. Application Data

(63) Continuation of application No. 09/167,918, filed on Oct. 7, 1998, now Pat. No. 6,050,272.

(51) Int. Cl.[7] ..... A45D 8/04; A45D 24/00; A45D 7/02

(52) U.S. Cl. ..... 132/273; 132/156; 132/148; 132/212

(58) Field of Search ..... 132/273, 275, 132/219, 212, 106, 107, 109, 126, 129, 133, 138, 140, 148, 156

(56) References Cited

U.S. PATENT DOCUMENTS

D. 36,683 * 12/1903 Kingman ..... 132/273
581,040 * 4/1897 Shulz ..... 132/129
756,367 * 4/1904 Howe ..... 132/129
794,828 * 7/1905 Winn ..... 132/160
1,533,380 * 4/1925 Burkhart ..... 132/273
2,202,089 * 5/1940 Cobb ..... 132/16
2,474,212 * 6/1949 Benco ..... 132/138
2,564,239 * 8/1951 Voight ..... 132/42
2,598,943 * 6/1952 Solomon ..... 132/42
4,844,103 * 7/1989 Vick et al. ..... 132/245
5,458,108 * 10/1995 Jacobs ..... 132/273
5,706,836 * 1/1998 Mckeown ..... 132/278
6,050,272 * 4/2000 Droin ..... 132/273

* cited by examiner

*Primary Examiner*—John J. Wilson
*Assistant Examiner*—Robyn Kieu Doan
(74) *Attorney, Agent, or Firm*—Schweitzer Cornman Gross & Bondell LLP

(57) ABSTRACT

A device for holding the hair comprising a comb-like element having a base and a plurality of teeth projecting from the base. The base is flexible to allow it to flex between a first orientation in which the ends of the teeth are spaced apart from each other to a second orientation in which the ends of the teeth are brought towards each other to grip the hair. A substantially rigid, curved member is preferably connected to the base, the rotation of the curved member between alternative positions drives the base between the first and second orientation and selectively maintains the base in a chosen one of the orientations.

20 Claims, 3 Drawing Sheets

DEVICE TO HOLD THE HAIR

This application is a continuation of Ser. No. 09/167,918 filed Oct. 7, 1998 now U.S. Pat. No. 6,500,200.

The present invention relates to a device that holds the hair. Such a device is useful, for example, for hair styling, as well as for decoration purposes. The device may further incorporate a part or an ornamental element whereby the part or ornament can be maintained in position in the hair.

BACKGROUND OF THE INVENTION

Existing devices to hold the hair and/or to maintain an ornament in the hair are not always satisfactory, whether as a result of a weak or imperfect grip of the hair or because they are of limited usage or are of relatively complex structure and are expensive to manufacture.

It is accordingly a goal and purpose of the present invention to provide a hair-holding device which is of simple and convenient operation.

Still another purpose and goal of the present invention is to provide a hair-holding device which is of simplified construction, and which can be manufactured easily and economically.

Yet another purpose and goal of the present invention is to provide a hair-holding device which has teeth to hold the hair which can be moved between alternate positions for insertion into the hair and maintaining the hair.

A further purpose and goal of the present invention is to provide a hair-holding device which may be adapted to a variety of configurations, and which may include or support decorative or ornamental elements to further expand its usefulness.

BRIEF DESCRIPTION OF THE INVENTION

In accordance with the foregoing goals and purposes, the present invention comprises at least one comb-like element having teeth joined to a common base or barrette portion. The base is flexible and can alternatively take a first orientation in which the free ends of the teeth are separated from each other, allowing hair to pass and be inserted between them, and a second orientation in which the free ends of the teeth are brought towards each other in order to grip the hair therebetween.

Means are provided to retain the base alternatively in the first and the second orientations.

The device is placed in the hair while in the first orientation in such a way that teeth can penetrate the mass of hair, whereby sections of hair lie between the separated or splayed teeth. The base or barrette is then brought to its second orientation, which causes the free ends of the teeth to be urged towards each other, closing upon the hair, providing a firm grip of the hair and thus snugly retaining the device in the chosen position in the hair.

The teeth can be arranged generally perpendicularly to the length of the base or barrette. In such an embodiment, the free ends diverge from one another in the first orientation and converge toward each other in the second orientation. Preferably, however, the teeth may be oriented with respect to the barrette in such a way that they are more or less parallel to one another in the first orientation. Introduction of the comb into the hair is thereby facilitated, a sufficient quantity of hair being introduced between the teeth along the entire length of the device to allow a firm grip of the hair by the teeth to be made when the barrette is placed in the second orientation, the teeth converging to provide the desired grip.

The means that allow the barrette to be alternatively maintained in the first and second orientations may comprise a nonelastic material that can be manually transiently deformed, such as an appropriate metallic material. In accordance with a preferred construction, the device entails the inclusion of such a material in the form of a rigid element in the base or barrette. The rigid element preferably has a curved configuration along its length. The rigid element is mounted to the barrette, whereby the rigid element can be transformed from a first position, in which a convex side of the rigid element is facing the teeth supported by the barrette, to a second position in which the concave side of the rigid element is facing the teeth. The barrette, which is constructed of a suitable flexible material, such as plastic, adapts itself to the shape of the rigid element and itself takes either a convex shape or a concave shape in accordance with the position of the rigid element, such that the teeth projecting from the length of the base or barrette are presented in alternatively separated or closed configurations.

A pivoting arm may further be mounted on one end of the barrette. The arm can pivot between a first, open position in which it is clear of the teeth and presents no obstacle to the introduction of the teeth into the hair, and a second, closed position across the teeth, in which a free end of the arm can be attached to the other end of the barrette, assisting in the further retention of the hair by the closed teeth. The arm can provide supplementary security for the retention of the hair.

BRIEF DESCRIPTION OF THE DRAWINGS

A fuller understanding of the invention will be obtained upon review of the following description of illustrative embodiments thereof, when considered in connection with the annexed drawings, wherein.

For simplification, similar elements which are represented are referred to by the same numerical reference.

DETAILED DESCRIPTION OF THE INVENTION

Figure 1:
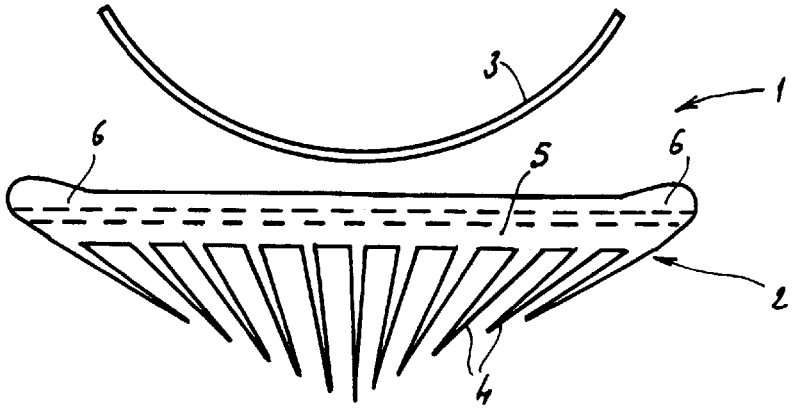
FIG. 1 is an elevation view of a first embodiment of the invention, its two constitutive elements shown separated.

FIGS. 1–4 represent a first embodiment of the invention as an accessory 1 to hold or ornament the hair which includes an element 2 more or less in the shape of a comb, and a pin or rod 3.

Comb-like element 2 may be made from a ductile plastic material, such as polyethylene. It includes teeth 4 held by or mounted at their first ends to a base or barrette portion 5, the cross-section of which is sufficiently small in order to be flexible as explained hereafter.

As shown in FIG. 1, in the unflexed state of the barrette 5 the teeth may be oriented in such a way that their distal teeth ends converge toward the center of the barrette.

The rod has sufficient rigidity such that when it is mounted to the comb, the comb conforms along its length to the curvature of the rod. The rod is further mounted to the comb in a manner which permits the rod to rotate about its ends, such that its opposed concave and convex sides can alternatively face the teeth of the comb. A preferred material is spring steel, which will maintain its curvature while providing sufficient flex and resiliency to permit it to rotate upon the application of an exterior force by the user.

In the embodiment of FIGS. 1–4 the barrette has two embossments 6 at its ends, and an embossment 7 in the center to support the rod and permit it to rotate. The embossments are located on the opposite side of the barrette from the teeth. Both end embossments have a blind or stepped hole, while the middle embossment has a thorough hole. Each of these holes is dimensioned to accommodate the metallic rod 3 while allowing the rod to freely pivot therein.

To be installed on the element 2 the pin may be first threaded through the middle embossment hole then into the blind holes in the end embossments. Due to the ductility of the barrette, the embossments can be slightly distorted as may be required for insertion.

Figure 2:
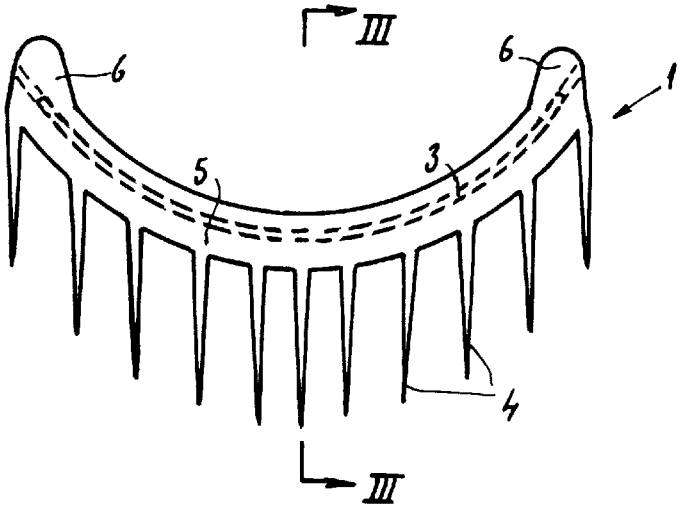
FIG. 2 is a similar view after assembly of the elements.
Figure 3:
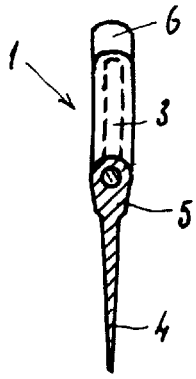
FIG. 3 is a section view taken along line III—III of FIG. 2.

With the pin inserted, the barrette assumes a curved orientation as dictated by the curve of the pin, as shown in FIG. 2. The pin 3 can pivot in relation to element 2 when an appropriate distorting force is applied to the barrette, such as by pushing or flexing both ends of the barrette or the embossments sideways with respect to the central section of the barrette. In the presence of a distorting force, the rod 3 thus rotates or flips about its ends, such that its curvature is in the opposite sense, the rod and barrette passing from the orientation of FIG. 2 to the orientation of FIG. 4.

In the position shown in FIG. 2, the convex side of the rod is facing the teeth side of the barrette 5, which is distorted and retained in such a way that it presents a similar convex shape on its teeth side. The teeth are generally parallel to each other to allow the insertion of the hair between the teeth.

Figure 4:
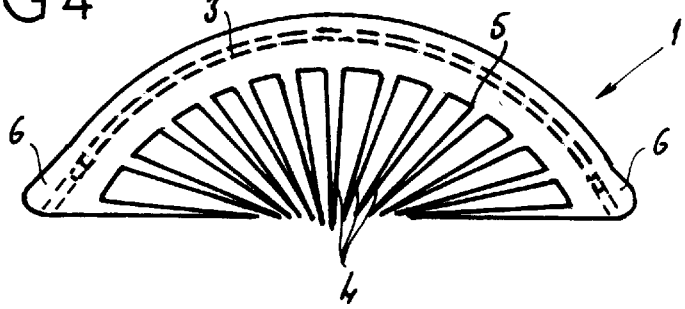
FIG. 4 is an elevation view of the embodiment of FIG. 2 in the second or closed orientation.

In the position as shown in FIG. 4, the concave side of the rod is facing the teeth side of the barrette, which is distorted and retained such that it presents a similar concave shape on its teeth side; the distal ends of the teeth are brought towards each other decreasing the effective spacing between the teeth and thereby holding the hair between the teeth.

Because of the spring-like nature of the rod, any displacement of the teeth from the orientation which they would normally assume due to the presence of the hair between them causes a restoring force to be generated by the rod, further biasing the teeth against the hair allowing the hair to be gripped securely. The grip remains until the barrette is pivoted back to its original position, the rod assuming its first, convex orientation with respect to the teeth, causing the teeth to spread apart to release the hair.

Figure 3A:
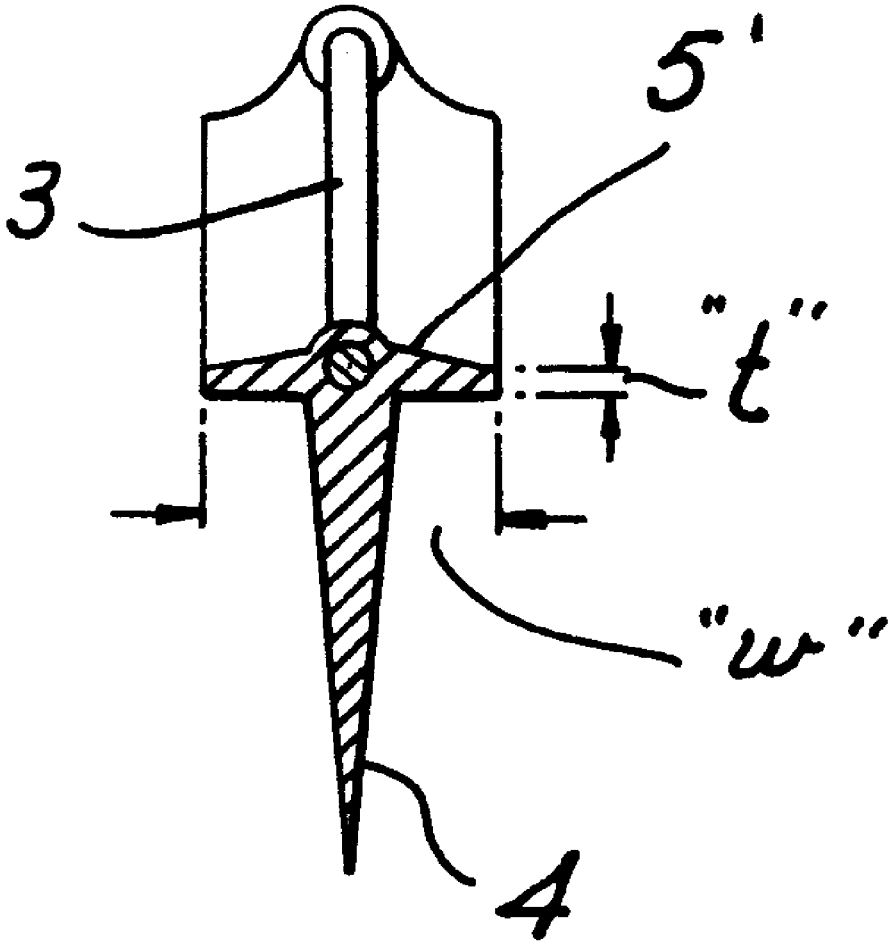
FIG. 3A is a similar section view of an alternative construction for the embodiment of FIG. 2.

FIG. 3A depicts an embodiment which provides increased resistance to displacement, and particularly lateral distortion, from the alternative open and closed positions. As shown therein, the barrette 5' is of a generally flat appearance in cross-section, having a width "w" substantially greater than its height or thickness "t". In this embodiment the rod 3 is preferably located within an internal bore in the central portion of the barrette.

Because the width of the barrette is greater than its thickness, the barrette is much more flexible in the plane of the teeth than in other directions and resists distortion in such other directions. Thus, the force exerted by the rod urges the barrette into one of the alternative open and closed positions. When the comb is manually opened or closed, the user exerts a force whereby the barrette's increased resistance to distortion out of the plane of the teeth is overcome. As sideways distortion of the barrette progresses, the rod 3 rotates within the barrette into new orientations until an angle of 90 degrees to the plane of the teeth is reached and passed, at which point no additional manual lateral distortion force is needed, as the natural tendency of the barrette to return to a position of minimum stress assists the rod's spring force in urging the barrette into the corresponding open or closed position, and maintaining the position against small distorting forces.

Figure 5:
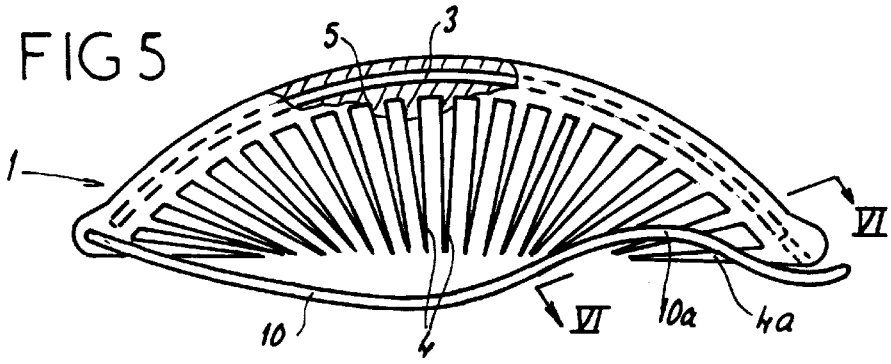
FIG. 5 is an elevation view of another embodiment of the invention.

The embodiment shown in FIG. 5 includes a variation of the generally comb-shaped element 2 with a base or barrette also having an interior bore or tube along its length which serves as a support for the rod, similarly allowing it to rotate with respect to the barrette. The tube extends through one end of the bases at 8, allowing the rod 3 to be inserted.

As shown in FIG. 5, the element 2 may also support a pivotable arm or lock 10 which can pivot between a position away from the element 2 and teeth 4 in which it does not prevent the teeth 4 from closing on the hair, and another position, as shown in FIG. 5, in which it extends across the distal ends of the teeth and thereby assists in retaining the hair between the teeth.

Figure 6:
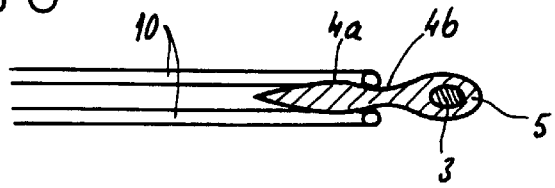
FIG. 6 is a section view taken along line VI—VI of FIG. 5.

The arm 10 may be made of an appropriately shaped metal or plastic element. The arm may be in the form of a looped wire-like structure, its ends being curved to form a pair of hook-like portions 11 fitting into opposite ends of a hole at a first end of element 2, allowing the element to rotate thereabout. The main portion of the arm 10 comprises a pair of spaced portions, as seen in FIG. 6, the portions embracing the teeth 4. The main portion of the element may be curved, and may include a section as at 10*a*, which allows the arm to contact opposite sides of the teeth located at the end of the barrette opposite the hole in which the arm pivots.

As shown in FIG. 6, these teeth have a widened distal cross-section 4*a* that slightly distorts each side of the lock arm 10, as well as a narrower section 4*b* closer to the base of the teeth to allow the lock arm to return to its unstressed shape, retaining the lock arm on the teeth.

Figure 7:
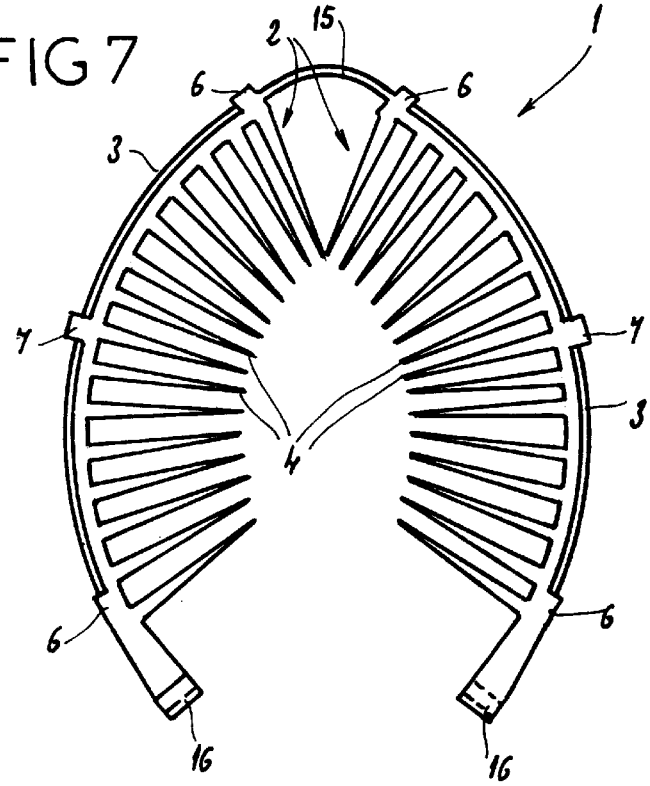
FIG. 7 is an elevation view of yet another embodiment.

FIG. 7 shows a further embodiment of the invention 1 including two elements 2 and 3. Those elements are connected at their adjoining first ends by a flexible intermediate portion 15; a pair of hooks 16 or any other mutual connecting devices are provided at their opposed distal ends to engage the distal ends when the device is placed in the hair. Such a shaped embodiment can be used, for example, with a ponytail or chignon. Each of the elements 2 and 3 is provided with a rod 3; each of the elements 2 and 3 can thus be placed in either of the convex or concave orientations of FIGS. 2 and 4.

It is self-evident that the invention is not limited to the herein-described embodiments, which are exemplary. Thus, for example, the lock arm section 10 can be made of plastic and can have at its free end any kind of fastening device, such as a catch, adapted to mate with any additional or corresponding fastening device at the corresponding end of the barrette. The barrette itself may have a decorative shape or support a decorative element in addition to the teeth; the lock arm section 10 can also have a decorative shape or have a decorative element, the device being slipped under the hair, in the case of a ponytail for example, the section 10 with the decorative element being pulled over the hair in order to become visible.

I claim:

1. A device for holding the hair, comprising a comb-like element having a base supporting a plurality of teeth lying in a flat plane, the base having two mutually-exclusive orientations and being transformable between the first orientation in the plane in which the distal ends of adjacent teeth are spaced apart from each other and the second orientation in the plane in which the distal ends of adjacent teeth are brought towards each other; and means for alternatively retaining the base in alternative ones of said first and second orientations.

2. The device of claim 1, wherein said retaining means comprise a rod extending longitudinally along said base in the plane.

3. The device of claim 2, wherein said rod is curved along the plane.

4. The device of claim 3, wherein said rod is of spring steel.

5. The device of claim 3, wherein said rod is mounted to said base.

6. The device of claim 4, wherein said base includes a longitudinal bore, said rod being located within said bore.

7. The device of claim 4, wherein said base includes a pair of opposed end embossments to accept opposed ends of said rod and a central embossment through which the rod passes.

8. The device of claim 4, wherein said first orientation of said base is an orientation wherein a side of said base supporting said teeth assumes a convex orientation and said second orientation of said base is an orientation wherein said base supporting said teeth assumes a concave orientation.

9. The device of claim 1 further including a lock arm pivotally mounted to a first end of the base.

10. A device for holding the hair, comprising a comb-like element having a flexible base supporting a plurality of hair-engaging teeth lying in a flat plane having free ends along a side thereof;

a curved rod having first and second ends; and bearing means for supporting at least the ends of the rod upon said base for rotation of the rod about the bearing means and for maintaining the base to conform to the curved shape of the rod, whereby the rod can rotate between opposed final orientations in the flat plane to alternatively place the teeth side of the base into convex and concave curved orientations within the flat plane.

11. The device of claim 10 wherein said bearing means comprise embossments on said base.

12. The device of claim 10 wherein said bearing means comprise a longitudinally extending bore in said base.

13. The device of claim 10 wherein said rod is of spring steel.

14. The device of claim 10 wherein said teeth are mounted to said base whereby when the teeth side of the base is in the convex curved orientation the teeth are parallel.

15. The device of claim 10 wherein said teeth are mounted to said base whereby when the teeth side of the base is in the concave curved orientation the free ends of the teeth are directed towards each other.

16. The device of claim 10 wherein said teeth are mounted to said base whereby when the teeth side of the base is in the convex curved orientation the teeth are in an orientation to facilitate the passage of hair therebetween.

17. The device of claim 10 wherein said teeth are mounted to said base whereby when the teeth side of the base is in the concave curved orientation the free ends of the teeth are in an orientation to grip hair located therebetween.

18. A hair accessory, comprising:

a flexible comb having a base strip from which teeth project in a flat plane, the base strip having a center portion and outer ends; and a separate curved, substantially rigid, elongated member pivotally connected to the center portion and the outer ends for rotation between alternative first and second final positions in the flat plane.

19. The hair accessory as claimed in claim 18, wherein the comb flexes to the first position when the elongated member is in a first position and the comb flexes to the second position when the elongated member is in a second position.

20. The hair accessory as claimed in claim 18, wherein the base strip of the comb has a bore for receiving the elongated member.

* * * * *